US008737675B2

(12) United States Patent
Hiwatashi et al.

(10) Patent No.: US 8,737,675 B2
(45) Date of Patent: May 27, 2014

(54) SPEAKER UNIT INCLUDING DIAPHRAGM HAVING A VOICE COIL ATTACHED THERETO

(75) Inventors: Hideki Hiwatashi, Yao (JP); Yuki Kobayashi, Daito (JP); Hidemi Kamada, Neyagawa (JP)

(73) Assignee: SANYO Electric Co., Ltd., Moriguchi-shi, Osaka (JP)

( * ) Notice: Subject to any disclaimer, the term of this patent is extended or adjusted under 35 U.S.C. 154(b) by 651 days.

(21) Appl. No.: 13/026,744

(22) Filed: Feb. 14, 2011

(65) Prior Publication Data

US 2011/0200223 A1 Aug. 18, 2011

(30) Foreign Application Priority Data

Feb. 16, 2010 (JP) ..... 2010-031069

(51) Int. Cl.
*H04R 1/00* (2006.01)
*H04R 9/00* (2006.01)
*H04R 11/02* (2006.01)

(52) U.S. Cl.
USPC ..... 381/409; 381/400; 381/405

(58) Field of Classification Search
USPC ..... 381/400, 405, 409, 423
See application file for complete search history.

(56) References Cited

U.S. PATENT DOCUMENTS

| | | | | |
|---|---|---|---|---|
| 2004/0218779 | A1* | 11/2004 | Fukuyama et al. | 381/409 |
| 2005/0175205 | A1* | 8/2005 | Takahashi | 381/409 |
| 2006/0018500 | A1* | 1/2006 | Watanabe | 381/398 |
| 2008/0205689 | A1* | 8/2008 | Lutz | 381/409 |
| 2010/0195863 | A1 | 8/2010 | Fujimoto et al. | |
| 2011/0123061 | A1* | 5/2011 | Kamimura et al. | 381/412 |

FOREIGN PATENT DOCUMENTS

| | | | |
|---|---|---|---|
| JP | 2002-125290 | A | 4/2002 |
| JP | 2003-264890 | A | 9/2003 |
| JP | 2007-104541 | A | 4/2007 |
| WO | 2008/059595 | A1 | 5/2008 |

OTHER PUBLICATIONS

Japanese Office Action dated Aug. 20, 2013, issued in corresponding Japanese Patent Application No. 2010-031069, w/ English translation (6 pages).

* cited by examiner

*Primary Examiner* — Jesse Elbin
(74) *Attorney, Agent, or Firm* — Westerman, Hattori, Daniels & Adrain, LLP

(57) ABSTRACT

A speaker unit that can prevent a lead from being broken is provided. The speaker unit includes: a diaphragm; a voice coil which is secured to the diaphragm; and a lead which is connected to the voice coil to energize the voice coil. The diaphragm includes an annular securing portion which has the voice coil secured thereto, and an outer projection which projects with respect to the securing portion at a side corresponding to a surface of the diaphragm having the voice coil secured thereto and extends along the securing portion. The outer projection has a top. The outer projection has the top partially recessed to have a recess. The lead extends across the recess to traverse the outer projection.

4 Claims, 4 Drawing Sheets

SPEAKER UNIT INCLUDING DIAPHRAGM HAVING A VOICE COIL ATTACHED THERETO

CROSS REFERENCE TO RELATED APPLICATION

This nonprovisional application is based on Japanese Patent Application No. 2010-031069 filed with the Japan Patent Office on Feb. 16, 2010, the entire contents of which are hereby incorporated by reference.

BACKGROUND OF THE INVENTION

1. Field of the Invention

The present invention relates generally to a speaker unit and particularly to a speaker unit including a diaphragm having a voice coil attached thereto.

2. Description of the Related Art

Conventional art of a diaphragm for a speaker used in a speaker unit is described for example in Japanese Patent Laying-Open No. 2003-264890. More specifically, Japanese Patent Laying-Open No. 2003-264890 proposes a diaphragm for a speaker, including a diaphragm, a voice coil provided at an annular, recessed fitting portion provided at a back surface of the diaphragm, and a circumferential holding ring provided to the diaphragm circumferentially, the diaphragm having a larger thickness at the annular, recessed fitting portion than at the circumference to prevent the voice coil from easily coming off.

Japanese Patent Laying-Open No. 2003-264890 provides the diaphragm for a speaker with an annular, recessed fitting portion and provides radially outwardly of the annular, recessed fitting portion a projection projecting at the back surface of the diaphragm. A voice coil is provided at the annular, recessed fitting portion and the voice coil has a lead connected thereto and extending over the projection and via the circumferential holding ring to an external terminal.

The lead that straddles the projection is bent and thus undergoes stress. When the speaker unit is driven for a long period of time with the lead undergoing stress, the lead suffers metal fatigue and is broken.

SUMMARY OF THE INVENTION

The present invention contemplates a speaker unit capable of preventing a lead from being broken.

The present speaker unit includes: a diaphragm; a voice coil which is secured to the diaphragm; and a lead which is connected to the voice coil to energize the voice coil. The diaphragm includes an annular securing portion which has the voice coil secured thereto, and a projection in the form of an elongate ridge which projects with respect to the securing portion at a side corresponding to a surface of the diaphragm having the voice coil secured thereto and extends along the securing portion. The projection in the form of the elongate ridge has a top. The projection in the form of the elongate ridge has the top partially recessed to have a recess. The lead extends across the recess to traverse the projection in the form of the elongate ridge.

The present speaker unit can prevent a lead from being broken.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Hereinafter reference will be made to the drawings to describe the present invention in embodiments. In the figures, identical or corresponding components are identically denoted and will not be described repeatedly in detail.

First Embodiment

Figure 1:
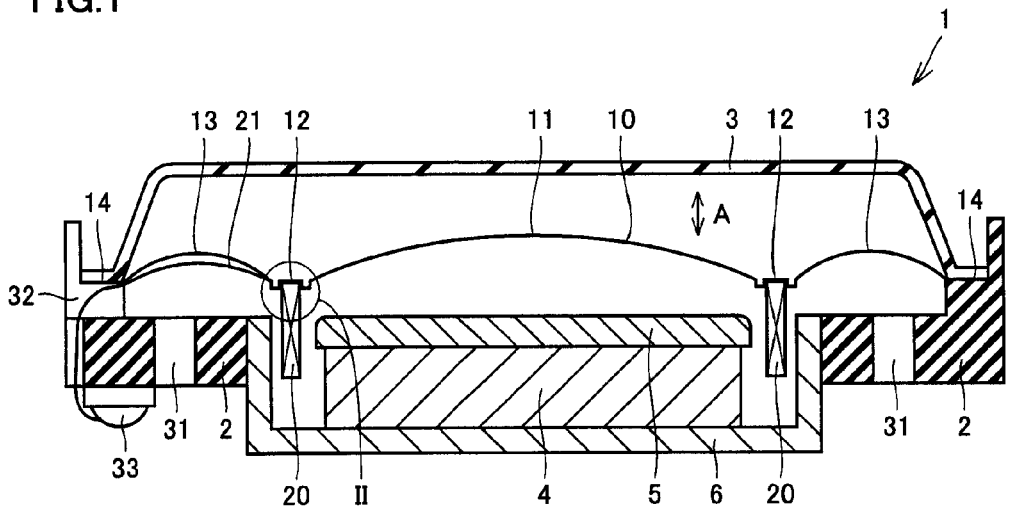
FIG. 1 shows a configuration of a speaker unit in a first embodiment in cross section.

As shown in FIG. 1, a speaker unit 1 mainly includes a frame 2, a cover 3, a magnet 4, a plate 5, a yoke 6, a diaphragm 10, and a voice coil 20.

Frame 2 is annular as seen in a plane and has an inner circumferential surface supporting yoke 6. Frame 2 has an upper portion with cover 3 placed thereon. Cover 3 has a trapezoidal cross section toward its top surface. Frame 2 and cover 3 pinch diaphragm 10.

Diaphragm 10 is formed of a thin plate to be capable of vibration in upward and downward directions (a direction indicated in FIG. 1 by an arrow A). Diaphragm 10 is for example a flexible membrane having a thickness of 8 μm to 50 μm. Diaphragm 10 is formed of synthetic resin represented for example by polyethylene terephthalate (PET), polyethylene naphthalate (PEN), polyetherimide (PEI) or the like.

Diaphragm 10 as seen in a plan view includes a central portion 11, an annular securing portion 12 provided radially outwardly of central portion 11 and having voice coil 20 secured thereto, an outer portion 13 provided radially outwardly of securing portion 12, and a periphery 14 provided radially outwardly of outer portion 13. Central portion 11 and outer portion 13 are arcuate as seen in the FIG. 1 cross section. Securing portion 12 has a lower surface having a top surface of voice coil 20 bonded thereto to secure voice coil 20 to diaphragm 10. Diaphragm 10 is attached to an upper portion of frame 2 such that periphery 14 has a lower surface opposite to an upper surface of frame 2.

Cover 3 is attached to an upper portion of diaphragm 10 such that periphery 14 has an upper surface opposite to a lower surface of a periphery of cover 3. Cover 3 is formed to cover diaphragm 10. Cover 3 is supported by frame 2 via diaphragm 10. Frame 2 has an upper surface with the diaphragm 10 periphery 14 placed thereon and frame 2 and cover 3 have upper and lower surfaces, respectively, supporting diaphragm 10 to be capable of vibration in speaker unit 1.

Yoke 6 has a radially outer portion provided radially outwardly of voice coil 20 and spaced from an outer circumferential surface of voice coil 20, and a bottom located under voice coil 20 and magnet 4. Yoke 6 has the radially outer portion with a radially outer side in physical contact with an inner circumferential surface of frame 2 and is thus secured. Yoke 6 has the bottom spaced from a bottom surface of voice coil 20, and magnet 4 is placed at a center of the bottom of yoke 6.

Magnet 4 is placed radially inwardly of voice coil 20 and spaced from an inner circumferential surface of voice coil 20. Voice coil 20 is placed in a magnetic field created by magnet 4. Plate 5 is placed on a top surface of magnet 4. Frame 2 supports magnet 4 and plate 5 via yoke 6. Speaker unit 1 has magnet 4 in the form of a column surrounded by voice coil 20 in the form of a cylinder, i.e., is of an internal magnet type. Magnet 4, which is a permanent magnet, is placed in yoke 6 provided in the form of a pot. Magnet 4, plate 5 and yoke 6 together form a magnetic circuit.

Frame 2 as seen depthwise (or in the upward and downward directions as seen in FIG. 1) has a plurality of through holes 31 penetrating frame 2. Through hole 31 serves as a ventilation hole allowing air to pass therethrough and thus flow between inside and outside speaker unit 1. When speaker unit 1 is driven, diaphragm 10 vibrates in the upward and downward directions, and accordingly, an air current is caused around diaphragm 10. At the time, the ventilation holes or the plurality of through holes 31 allow air to flow therethrough from inside to outside speaker unit 1 and vice versa. This can prevent an air current from inhibiting vibration of diaphragm 10 and thus impairing speaker unit 1 in performance.

Frame 2 has a lower surface with a terminal 33 secured thereto for connecting an electric circuit that is included in speaker unit 1 to another circuit, device and/or the like. Frame 2 and yoke 6 are assembled together such that frame 2 has the lower surface above the bottom of yoke 6 provided in the form of the pot. As such, frame 2 having the lower surface with terminal 33 attached thereto projecting downward does not provide speaker unit 1 as a whole with an increased geometrical dimension, and speaker unit 1 can thus be miniaturized.

Frame 2 also has a connection hole 32 connecting spaces internal and external to speaker unit 1. A lead 21 is passed through connection hole 32. Lead 21 has one and the other ends connected to voice coil 20 and terminal 33, respectively. Terminal 33 and voice coil 20 are electrically connected by lead 21. Lead 21 is connected to voice coil 20 to energize voice coil 20. Terminal 33 and lead 21 pass a current to voice coil 20.

Figure 2:
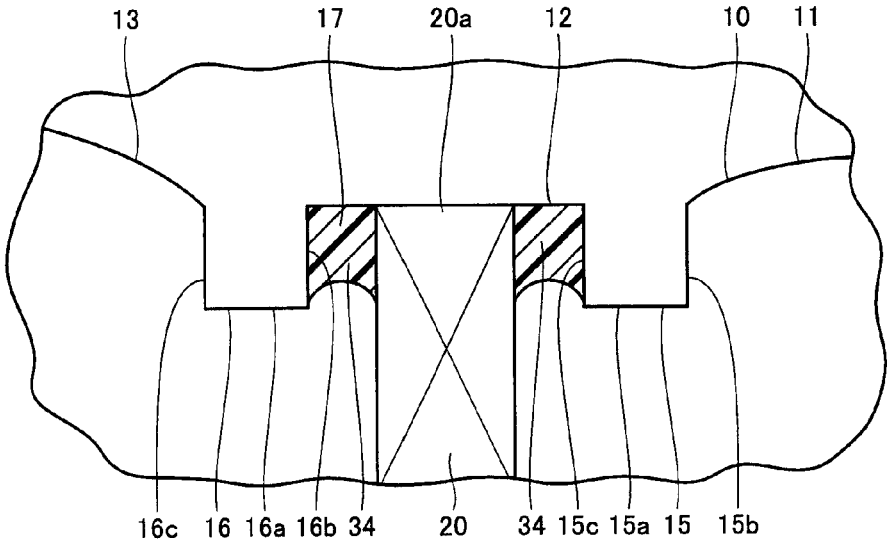
FIG. 2 schematically shows in an enlarged view an area II shown in FIG. 1.

Reference will now be made to FIG. 2 to more specifically describe a structure in a vicinity of securing portion 12 securing voice coil 20 to diaphragm 10. As seen in the FIG. 2 cross section, securing portion 12 is formed flat. Voice coil 20 is formed of a conductive wire wound about an axis parallel to the upward and downward directions indicated in FIG. 1 by a two-head arrow A and is in the form of a cylinder. When voice coil 20 receives an alternate current, diaphragm 10 can be vibrated in the upward and downward directions.

Voice coil 20 has ends, and of the ends, an end 20*a* closer to the diaphragm 10 securing portion 12 is in physical contact with securing portion 12. Securing portion 12 formed flat allows the voice coil 20 end 20*a* and the diaphragm 10 securing portion 12 to physically contact each other over a large area. This allows voice coil 20 to be bonded and thus secured to diaphragm 10 with increased adhesive strength. Note that securing portion 12 is not limited to flat geometry, and it may for example have a recess to reserve an adhesive. As voice coil 20 is in the form of a cylinder, securing portion 12, serving to have voice coil 20 secured thereto, is provided in the form of an annulus corresponding in geometry to voice coil 20.

As shown in FIG. 2, provided radially inwardly of securing portion 12 is an inner projection 15. Furthermore, provided radially outwardly of securing portion 12 is an outer projection 16. Inner projection 15 and outer projection 16 project with respect to securing portion 12 at a side of diaphragm 10 corresponding to a surface of diaphragm 10 having voice coil 20 secured thereto. Inner projection 15 and outer projection 16 project relative to that surface of diaphragm 10 which is located at a side having voice coil 20 secured to securing portion 12.

Inner projection 15 is in the form of an elongate ridge extending along annular securing portion 12 radially inwardly of securing portion 12. Outer projection 16 is in the form of an elongate ridge extending along annular securing portion 12 radially outwardly of securing portion 12. Inner projection 15 and outer projection 16 are included in a projection in the form of the elongate ridge. Diaphragm 10 includes the projection in the form of the elongate ridge. The projection in the form of the elongate ridge has inner projection 15 and outer projection 16.

Inner projection 15 has a top 15*a*. Top 15*a* is a surface defining a snout, i.e., the most projecting end, of inner projection 15 projecting relative to the diaphragm 10 central portion 11 and securing portion 12. Inner projection 15 also has a radially inner wall 15*b* facing the diaphragm 10 central portion 11. Inner projection 15 also has a radially outer wall 15*c* facing the diaphragm 10 securing portion 12. Radially outer wall 15*c* defines a wall surface of inner projection 15 opposite to voice coil 20 secured to securing portion 12.

Outer projection 16 has a top 16*a*. Top 16*a* is a surface defining a snout, i.e., the most projecting end, of outer projection 16 projecting relative to the diaphragm 10 securing portion 12 and outer portion 13. Outer projection 16 also has a radially inner wall 16*b* facing the diaphragm 10 securing portion 12. Radially inner wall 16*b* defines a wall surface of outer projection 16 opposite to voice coil 20 secured to securing portion 12. Outer projection 16 also has a radially outer wall 16*c* facing the diaphragm 10 outer portion 13.

Securing portion 12 has opposite sides with a pair of projections in the form of elongate ridges projecting relative to securing portion 12 at a side having voice coil 20 secured to securing portion 12. The pair of projections in the form of the elongate ridges, i.e., inner projection 15 and outer projection 16, and securing portion 12 together form a groove 17. Voice coil 20 is placed in groove 17 in the form of an annulus defined by inner projection 15, outer projection 16 and securing portion 12. Groove 17 internally receives an adhesive 34 to bond and secure voice coil 20 to diaphragm 10.

Adhesive 34 is applied in groove 17, and groove 17 serves as an adhesive reservoir reserving adhesive 34 therein. Inner projection 15 and outer projection 16 projecting from securing portion 12 are provided at inner and outer sides of that portion of diaphragm 10 having voice coil 20 stuck thereto, or securing portion 12, to form groove 17. The adhesive reservoir or groove 17 is structured to reserve adhesive 34 therein.

As shown in FIG. 2, inner projection 15 and outer projection 16 project equally in height as measured from securing portion 12. More specifically, as seen in the upward and downward directions indicated in FIG. 1 by two-head arrow A, the inner projection 15 top 15*a* and the outer projection 16 top 16*a* are substantially equal in distance from securing portion 12. Inner projection 15 and outer projection 16 projecting equally in height allow groove 17 to be filled with adhesive 34 both inwardly and outwardly of voice coil 20 equally.

As shown in FIG. 2, the inner projection 15 radially outer wall 15*c* and the outer projection 16 radially inner wall 16*b* are substantially vertically erect with respect to flat securing portion 12. Radially outer wall 15*c* and radially inner wall 16*b* have a steep gradient having an angle close to a right angle to the flat plane of securing portion 12 and are formed to be erect with respect to securing portion 12. Inner projection 15 and outer projection 16 thus formed help to reserve adhesive 34 in groove 17.

Reserving adhesive 34 in groove 17 allows diaphragm 10 and voice coil 20 to be bonded together via adhesive 34 and hence over an increased area. This allows diaphragm 10 and voice coil 20 to be bonded together with increased adhesive strength.

Bonding voice coil 20 to diaphragm 10 with increased adhesive strength can reduce a noise caused in driving speaker unit 1, as if something resonated, that is attributed to voice coil 20 otherwise insufficiently bonded. Furthermore, bonding with increased adhesive strength can prevent the bonded portion from coming off while speaker unit 1 is driven over a long period of time, and speaker unit 1 can be enhanced in reliability. Furthermore, the bonded portion with increased adhesive strength can provide speaker unit 1 with an improved sound pressure characteristic.

Furthermore, the inner projection 15 radially outer wall 15*c* and the outer projection 16 radially inner wall 16*b* define side wall surfaces of groove 17. These side walls of groove 17 serve as a positioning guide for registration of voice coil 20 in placing voice coil 20 in groove 17. More specifically, voice coil 20 is inserted in groove 17 between inner projection 15 and outer projection 16 and stuck to diaphragm 10 with adhesive 34 introduced in groove 17. The guiding portion used in bonding and securing voice coil 20 to receive voice coil 20 can help to position voice coil 20 relative to diaphragm 10 with high precision.

Radially outer wall 15*c* and radially inner wall 16*b* formed to each form an angle substantially perpendicular to securing portion 12 and to be opposite to each other substantially parallel to each other help to position voice coil 20 in fitting voice coil 20 into groove 17. Radially outer wall 15*c* and radially inner wall 16*b* may form a right angle to the flat plane of securing portion 12 or may be offset from the right angle within a range of ±2° and thus slightly inclined relative to a flat plane perpendicular to the flat plane of securing portion 12.

Figure 3:
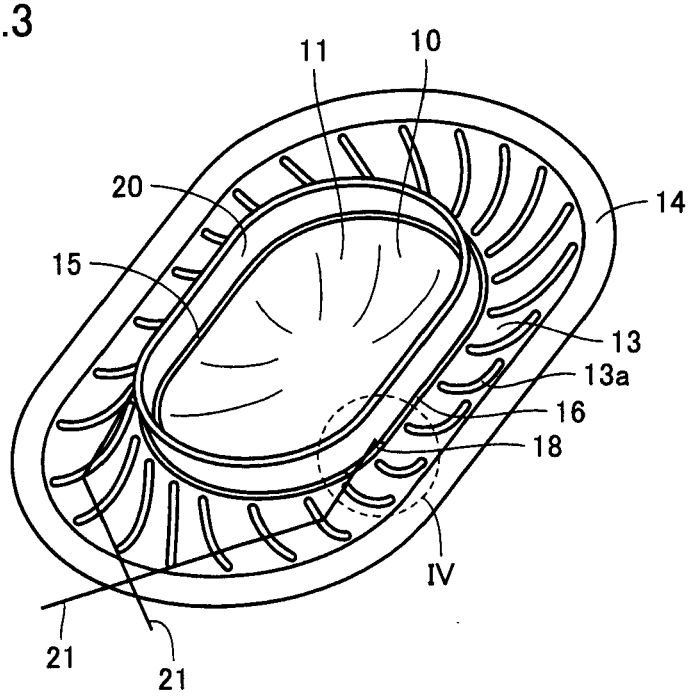
FIG. 3 is a perspective view of a voice coil secured to a diaphragm.

FIG. 3 shows the FIG. 1 diaphragm 10 and voice coil 20 upside down, in a structure with voice coil 20 bonded to diaphragm 10 integrally.

As shown in FIG. 3, the present embodiment provides diaphragm 10 generally in the form of a race track as seen in a plane. The form of the race track is formed of two opposite semicircles and two parallel linear portions connecting the two semicircles. Voice coil 20 attached to diaphragm 10 is also formed to match diaphragm 10 in geometry, i.e., in the form of a race track as seen in a plane. It should be noted, however, that diaphragm 10 and voice coil 20 are not limited to the above geometry, and may for example be circular as seen in a plane or may be any other form.

Diaphragm 10 in the form of the race track as seen in a plane has central portion 11 at the center, and outer portion 13 radially outwardly of central portion 11. Outer portion 13 has a plurality of grooves 13*a* spirally or radially. Periphery 14 formed of an annular flat plate in the form of a flange extends from outer portion 13 radially outwardly. Periphery 14 is pinched by frame 2 and cover 3 shown in FIG. 1 to attach diaphragm 10 to speaker unit 1.

Cylindrical voice coil 20 is secured to diaphragm 10 between central portion 11 and outer portion 13. Voice coil 20 is placed in groove 17 defined by inner projection 15 and outer projection 16 described with reference to FIG. 2. Lead 21 is connected to voice coil 20 for supplying voice coil 20 with a driving current. Voice coil 20 is formed of winding, which is drawn out of voice coil 20 to form lead 21. Voice coil 20 may have its winding connected at one end to a conductive wire different from the winding to form lead 21.

The projection in the form of the elongate ridge extending along securing portion 12 having voice coil 20 secured to diaphragm 10 includes outer projection 16. Outer projection 16 is formed by a portion of diaphragm 10 projecting at a surface of diaphragm 10 having voice coil 20 secured thereto. Outer projection 16 has a portion reduced in height to form a recess 18. Recess 18 is formed at outer projection 16. Outer projection 16 is partially recessed heightwise to form recess 18.

Figure 4:
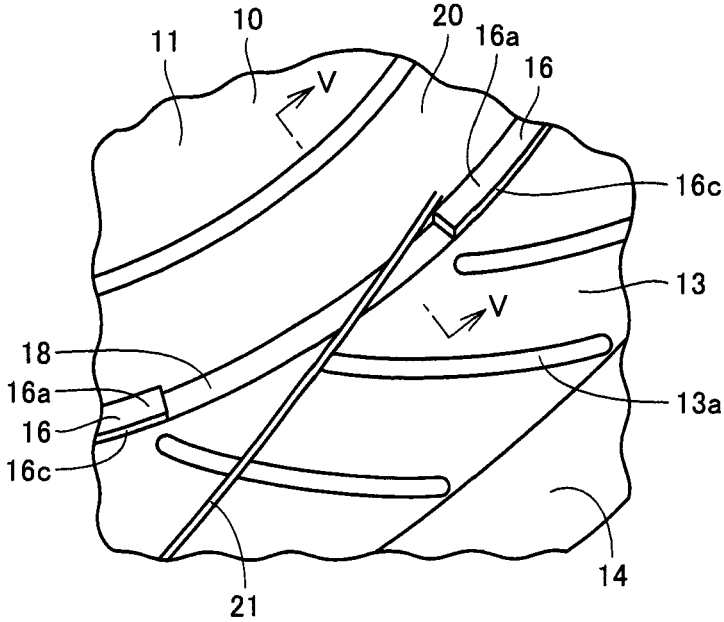
FIG. 4 schematically shows in an enlarged view an area IV shown in FIG. 3.

As shown in FIG. 4 more specifically, outer projection 16 provided radially outwardly of voice coil 20 secured to diaphragm 10 has top 16*a* defining a ceiling end of outer projection 16 in the form of the elongate ridge. As outer projection 16 is in the form of the elongate ridge extending along securing portion 12, top 16*a* forming the elongate ridge's top also extends along securing portion 12.

Outer projection 16 has top 16*a* partially recessed to form recess 18. Recess 18 is formed by notching a portion of top 16*a* of outer projection 16 away thoroughly as seen radially. Lead 21 connected to voice coil 20 extends across outer projection 16 through recess 18. Diaphragm 10 is geometrically formed such that outer projection 16 is absent only at a portion of diaphragm 10 corresponding to a port allowing lead 21 to be drawn out of voice coil 20.

Recess 18 can be formed without an additional production step by previously preparing a die geometrically corresponding to recess 18 in press-forming diaphragm 10. When diaphragm 10 is press-formed, recess 18 can concurrently be formed. This can eliminate the necessity of performing an additional step to form recess 18, and thus easily form recess 18 without increasing the cost for producing speaker unit 1.

Figure 5:
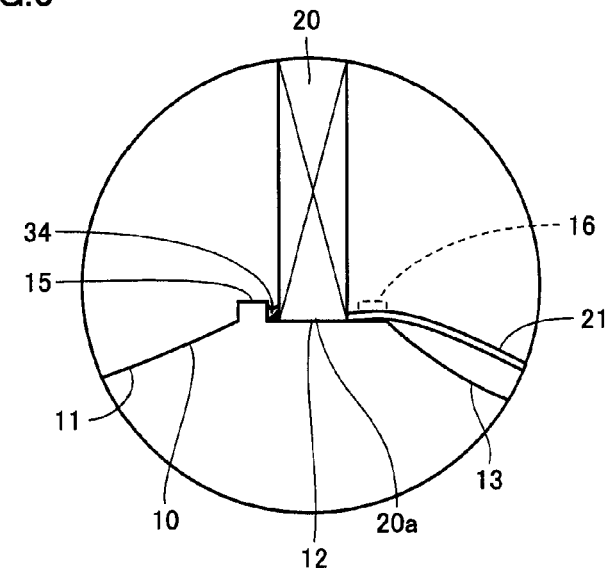
FIG. 5 is a cross section of the diaphragm taken along a line V-V shown in FIG. 4.

As shown in FIG. 5, as outer projection 16 is partially notched away to form recess 18, lead 21 drawn out of a coil bobbin of voice coil 20 extends radially outwardly of diaphragm 10 without being bent. Recess 18 eliminates the necessity of lead 21 climbing over outer projection 16 and hence straddling outer projection 16. This can prevent lead 21 from being bent and thus experiencing large stress.

When voice coil 20 is supplied with a current, speaker unit 1 is driven. More specifically, the current passing through voice coil 20 and a magnetic field created by magnet 4 vibrate voice coil 20 upward and downward in accordance with Fleming's left-hand rule. This vibrates diaphragm 10 bonded and secured to voice coil 20 and an electrical signal (or current) is converted to sound (or vibration).

At the time, lead 21 vibrates together with diaphragm 10 and voice coil 20 in the upward and downward directions. As lead 21 is not bent, the stress that lead 21 experiences can be reduced, and the possibility can be reduced that lead 21 may be broken by metal fatigue as speaker unit 1 is driven for a long period of time. Speaker unit 1 can thus be enhanced in reliability.

Lead 21 is connected to an end of voice coil 20 that is brought into physical contact with diaphragm 10 at securing portion 12, i.e., the voice coil 20 end 20*a*. As such, when diaphragm 10 vibrates, lead 21 is not in physical contact with another component of speaker unit 1, such as yoke 6 or frame 2 shown in FIG. 1, and can thus be prevented from being broken thereby, and diaphragm 10 can also be vibrated at increased amplitude.

In addition, with lead 21 connected to voice coil 20 at end 20*a*, drawing lead 21 out radially outward via recess 18 can more effectively prevent lead 21 from being bent. More specifically, if lead 21 straddles outer projection 16, lead 21 bends, and if in that condition lead 21 is connected to voice coil 20 at end 20*a*, lead 21 will bend with an increased curvature. In contrast, placing lead 21 in recess 18 and thus connecting lead 21 to voice coil 20 at end 20*a*, as done in the present embodiment, can prevent lead 21 from being disadvantageously bent and thus reduce stress acting on lead 21.

In the present embodiment, outer projection 16 does not project in recess 18 relative to securing portion 12. Recess 18 has a depth, which, as measured from top 16*a*, is equal to a height that outer projection 16 has as measured from securing portion 12. Accordingly, as shown in FIG. 5, securing portion 12 has a flat geometry extending to radially outer portion 13 and a flat plane that the voice coil 20 end 20*a* is in physical contact with extends to outer portion 13. Thus forming recess 18 can further prevent bending of lead 21. In other words, reducing the outer projection 16 top 16*a* in altitude can reduce bending of lead 21, and minimizing top 16*a* in altitude can further effectively reduce bending of lead 21.

Furthermore, in the present embodiment, of a pair of projections in the form of elongate ridges, only radially outer projection 16 is provided with recess 18. Lead 21 is a conductive wire used for electrically connecting voice coil 20 to external terminal 33, and accordingly, it is more advantageous that lead 21 is placed radially outwardly of voice coil 20 so as to be drawn out of voice coil 20 radially outward. In other words, placing lead 21 via recess 18 formed at outer projection 16 allows lead 21 to be placed with an increased degree of freedom and can also more effectively reduce/prevent physical contact between lead 21 and frame 2 or yoke 6 or the like.

Recess 18 is formed to extend in the circumferential direction of annular outer projection 16. More specifically, recess 18 is formed by recessing top 16*a* of a portion of outer projection 16, and as shown in FIG. 3 and FIG. 4, recess 18 is formed over a range in the circumferential direction of outer projection 16. For example, recess 18 may be formed to extend in the circumferential direction of outer projection 16 over a range corresponding to a sector which has its origin at the center of outer projection 16 in the form of a race track as seen in a plane and has a central angle of 30°.

Recess 18 thus formed allows lead 21 to be placed in an increased range as seen in the circumferential direction of outer projection 16. This can facilitate placing lead 21 in recess 18 and help to better attach voice coil 20. Furthermore, recess 18 as seen in the circumferential direction of outer projection 16 has opposite ends defined by tops 16*a* spaced by an increased distance. This can help to prevent lead 21 passing across recess 18 from being in physical contact with outer projection 16 having top 16*a*, and thus further prevent lead 21 from being bent by outer projection 16.

Second Embodiment

While in the first embodiment of the present invention diaphragm 10 and voice coil 20 are connected in a structure applied to a speaker unit of an internal magnet type, the present invention is also applicable to speaker unit 1 of an external magnet type having magnet 4 in the form of a ring surrounding voice coil 20.

Figure 6:
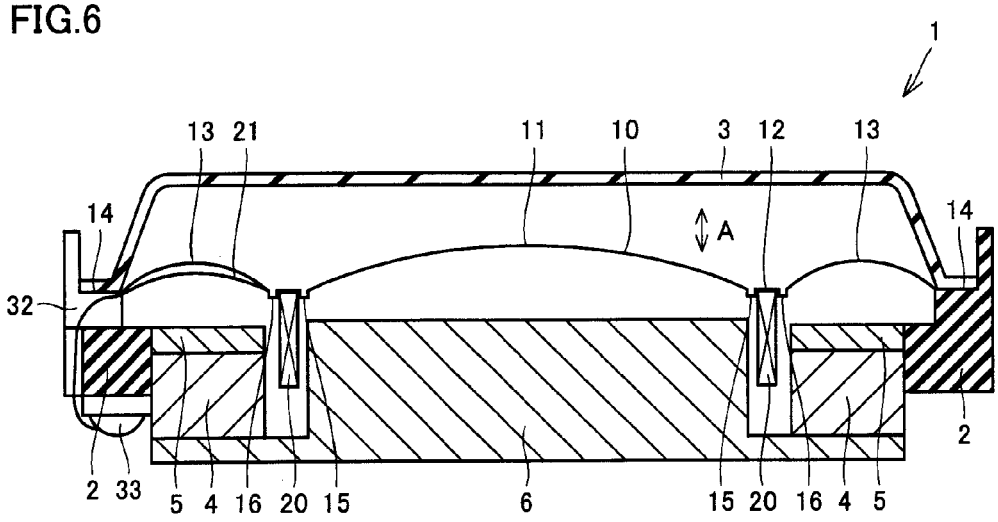
FIG. 6 shows a configuration of the speaker unit in a second embodiment in cross section.

As shown in FIG. 6, magnet 4 is placed radially outwardly of voice coil 20 and spaced from an outer circumferential surface of voice coil 20. Yoke 6 has a radially inner portion placed radially inwardly of voice coil 20 and spaced from an inner circumferential surface of voice coil 20, and a bottom under voice coil 20 and magnet 4. On the yoke 6 bottom, magnet 4 in the form of a ring is placed. On a top surface of magnet 4, plate 5 is placed.

Speaker unit 1 of the second embodiment thus configured also has diaphragm 10 having outer projection 16 having a top partially recessed to form a recess, and lead 21 connected voice coil 20 and extending radially outward across the recess. This can also reduce/prevent bending of lead 21 and hence stress acting on lead 21. Speaker unit 1 being driven can be prevented from having lead 21 broken and thus be enhanced in reliability.

Third Embodiment

In the first and second embodiments, the speaker unit has mounted therein a voice coil having a larger number of layers in the direction of the central axis of the voice coil (hereinafter referred to as the direction of the thickness) than in a direction transverse to the direction of the central axis of the voice coil (hereinafter referred to as the direction of the width). The present invention's structure connecting diaphragm 10 and voice coil 20 is also applicable to speaker unit 1 having mounted therein voice coil 20 having a geometry having a lager number of layers in the direction of the width than in the direction of the thickness.

Figure 7:
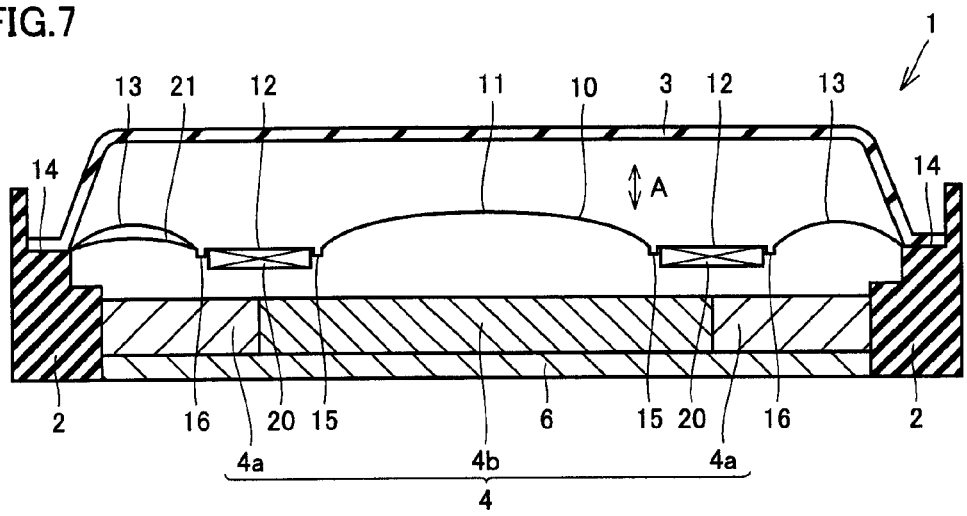
FIG. 7 shows a configuration of the speaker unit in a third embodiment in cross section.

As shown in FIG. 7, voice coil 20 is formed in a geometry having a lager number of layers in the direction of the width than in the direction of the thickness. Voice coil 20 is placed over a top surface of magnet 4 with a space therebetween. Voice coil 20 is placed so that a magnetic flux generated by magnet 4 traverses voice coil 20.

Magnet 4 is magnetized in the direction of the thickness. Magnet 4 includes a pair of an outer magnet 4*a* in the form of a rectangular parallelepiped and an inner magnet 4*b* in the form of a rectangular parallelepiped. Magnet 4 is secured such that an outer peripheral surface of outer magnet 4*a* and an inner peripheral surface of frame 2 are in physical contact with each other. Yoke 6 is secured to a bottom side of magnet 4. Yoke 6 is secured by having a side surface in physical contact with an inner peripheral surface of frame 2. Frame 2 has an inner peripheral surface supporting magnet 4 and yoke 6.

Figure 8:
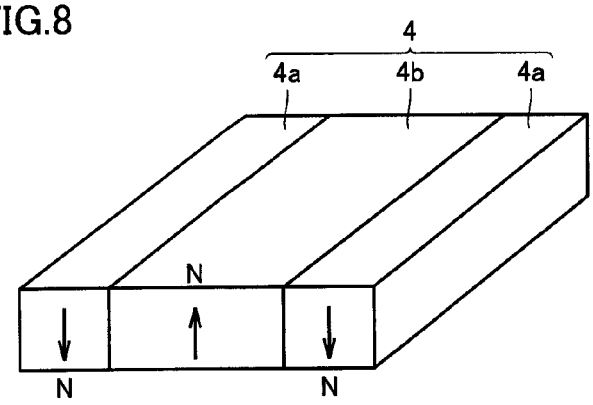
FIG. 8 is a perspective view of a magnet shown in FIG. 7.

With reference to FIG. 8, the paired outer magnet 4*a* and inner magnet 4*b* are magnetized in opposite directions. More specifically, the paired magnets are magnetized such that outer magnet 4*a* has a bottom surface to serve as a north pole and inner magnet 4*b* has a top surface to serve as a north pole. The paired outer magnet 4*a* and inner magnet 4*b* are only required to be magnetized in opposite directions. Accordingly, they may be magnetized such that outer magnet 4*a* has a top surface to serve as a north pole and inner magnet 4*b* has a bottom surface to serve as a north pole.

Figure 9:
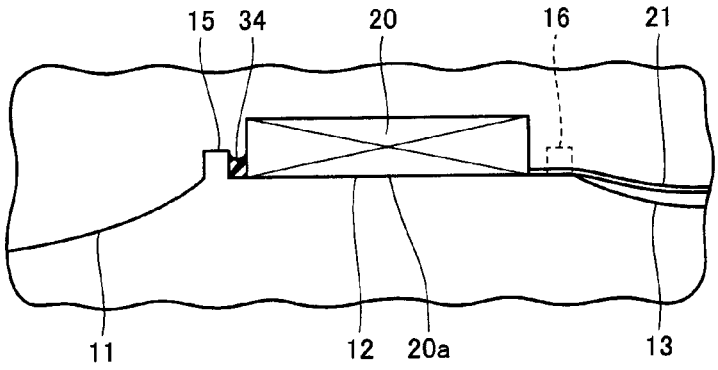
FIG. 9 shows a geometry of the diaphragm in the third embodiment in cross section.

As shown in FIG. 9, speaker unit 1 of the third embodiment also has diaphragm 10 having outer projection 16 having a top partially recessed to form a recess, and lead 21 connected to voice coil 20 at end 20*a* and extending outward across the recess. This can also reduce/prevent bending of lead 21 and hence stress acting on lead 21. Speaker unit 1 being driven can be prevented from having lead 21 broken and thus be enhanced in reliability.

The present speaker unit is advantageously applicable in particular to miniaturized microspeakers mounted in mobile phones, digital cameras, personal computers, portable game machines and other mobile information terminals.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A speaker unit comprising:

a diaphragm;

a voice coil which is secured to said diaphragm; and a lead which is connected to said voice coil to energize said voice coil, said diaphragm including an annular securing portion which has said voice coil secured thereto, and a projection which is provided in a form of an elongate ridge projecting with respect to said securing portion at a side corresponding to a surface of said diaphragm having said voice coil secured thereto, and extends along said securing portion, said projection in said form of said elongate ridge having a top, said projection in said form of said elongate ridge having said top partially recessed to have a recess, said lead extending across said recess to traverse said projection in said form of said elongate ridge, wherein said projection in said form of said elongate ridge has an inner projection formed radially inwardly of said securing portion, and an outer projection formed radially outwardly of said securing portion, and wherein said recess is formed at said outer projection.

2. The speaker unit according to claim 1, wherein said inner projection and said outer projection project substantially equally in height, as measured from said securing portion.

3. The speaker unit according to claim 1, wherein:

said projection in said form of said elongate ridge has a wall surface opposite to said voice coil secured to said securing portion; and said wall surface is formed to be erect with respect to said securing portion.

4. The speaker unit according to claim 1, wherein said lead is connected to that end of said voice coil which is adjacent to said securing portion of said diaphragm.

* * * * *